United States Patent [19]

Gronvall

[11] 3,984,983

[45] Oct. 12, 1976

[54] POWER CONTROL COMPRESSOR ARRANGEMENT IN HOT GAS ENGINE

[75] Inventor: Karl Olof Ragnar Gronvall, Borensberg, Sweden

[73] Assignee: Forenade Fabriksverken, Eskilstuna, Sweden

[22] Filed: Aug. 7, 1975

[21] Appl. No.: 602,734

[52] U.S. Cl. ..... 60/521

[51] Int. Cl.[2] ..... F02G 1/06

[58] Field of Search ..... 60/517, 521, 522, 525, 60/526

[56] References Cited

UNITED STATES PATENTS 2,616,248 11/1952 De Brey ..... 60/526

3,036,427 5/1962 Meijer ..... 60/521

*Primary Examiner*—Allen M. Ostrager

*Attorney, Agent, or Firm*—Laurence R. Brown

[57] ABSTRACT

For controlling power in a hot gas engine with hot and cold cylinder structure, a power control compressor is located in an accessible position at the upper part of the low temperature cylinder so that the compressor piston is operated by the engine piston. Power is controlled by introducing working gas or removing working gas through appropriate valves.

5 Claims, 1 Drawing Figure

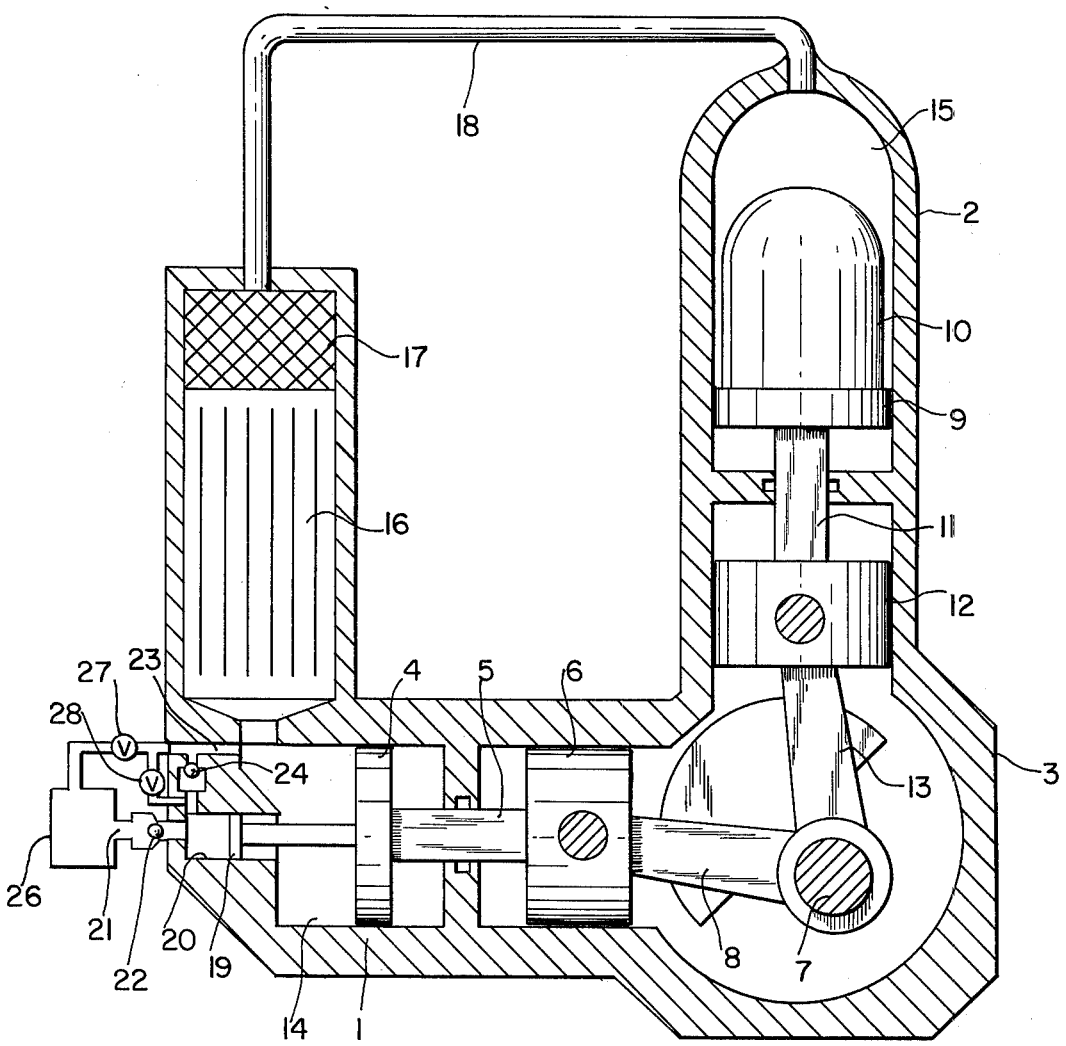
18
15
2
10
9
17
16
11
12
27
23
28
4
5
6
24
13
3
26
21
22
20
19
14
1
8
7

POWER CONTROL COMPRESSOR ARRANGEMENT IN HOT GAS ENGINE

BACKGROUND

This invention relates to a hot gas engine of the type comprising a first piston adapted to reciprocate in a first cylinder which is kept at a lower temperature level and a second piston adapted to reciprocate in a second cylinder which is kept at a higher temperature level, the said two pistons forming walls of an enclosure containing a working gas charge, said enclosure also comprising a cooler, a regenerator and a heater.

It is well known to control the power output of a hot gas engine by adjusting the amount of gas in the working gas charge. This is often done by pumping gas from said working gas charge into a gas reservoir when the power output should be decreased and by supplying gas into said working gas charge from said reservoir when the power output should be increased.

The gas pressure in the working gas charge will vary during the working cycles. Thus, the gas pressure may vary between e.g. 4 and 8 MPa at low power outputs and between 12 and 20 MPa at higher power outputs. In order to expose the compressor piston seals to smaller differential pressures it is most advantageous to install the compressor inside the engine so that any leakage will be at a relative high pressure i.e. at least the lowest of the practically occurring working gas pressures. However, when the compressor is arranged in a low temperature part of the engine the compressor parts of prior art construction have been inaccessible and therefore very difficult to inspect and service.

OBJECTS AND SHORT STATEMENT OF INVENTION

A general object of the invention is to provide improved compressors operable at high working pressures such as found in hot gas engines.

Another object of the present invention is to provide a hot gas engine in which the compressor is easy to service, but in which the compressor piston works at a high pressure at its non-compression side.

These objectives are obtained with the present invention by compressor structure carried at the upper side the said first piston, with a plunger working in a pump cylinder, a first check valve governed conduit leading from said pump cylinder to a gas reservoir and a second check valve governed conduit leading from a part of said enclosure located between said cooler and said first piston to said pump cylinder.

THE DRAWING

The novel features sought to be protected are defined with particularity in the appended claims and the structure, scope and operation of the invention is described in detail by reference to a preferred embodiment thereof with reference to the accompanying drawing, showing schematically in vertical plan view, partly in section, a hot gas engine and compressor arrangement afforded by the invention.

DETAILED DESCRIPTION

The engine shown comprises a first cylinder 1 and a second cylinder 2 both extending at 90° relative angle from a common crank casing 3. A first piston 4 located in the first cylinder 1 carries a piston rod 5 and a cross head 6 which is connected to a crank shaft 7 by means of a connecting rod 8. A second piston 9 located in the second cylinder 2 carries a dome 10, a piston rod 11 and a cross head 12. The cross head 12 is connected to the crank shaft 7 by a connecting rod 13. The crank casing end of the cylinder is termed herein the lower side of the cylinder.

The space above the first piston 4 within the first cylinder 1 is designated by 14, and the space above the second piston 9 and its dome 10 within the second cylinder 2 is designated by 15. Said spaces 14 and 15 contain a charge of working gas such as hydrogen or helium and communicate with each other through a cooler 16, a regenerator 17 and a number of heater tubes 18 — only one such tube being shown in the drawing. By continuously cooling the working gas charge in the cooler 16 and continuously supplying heat through the heater tube 18 the first cylinder 1 will be maintained at a low temperature level and the upper part of the second cylinder 2 at a high temperature level during normal operation of the engine.

The upper side of the first piston 4 is provided with a plunger 19 working in a pump cylinder 20. The pump cylinder 20 is provided with an outlet conduit 21 governed by a check valve 22 and leading to gas reservoir 26. A conduit 23 governed by a check valve 24 leads to the pump cylinder 20 from a location between the lower end of the cooler 16 and the space 14 above the first piston 4.

During running of the engine the plunger 19 will suck in gas from the working charge located in the variable volume spaces 14 and 15 as well as in the cooler 16, the regenerator 17 and the heater tubes 18. The gas will be compressed and delivered to the gas reservoir 26 through the conduit 21. If gas pumping from the working charge to the reservoir is not desired a shunting conduit 28 by-passing the valve 24 could be opened. If the amount of gas in the working charge should be increased gas may be supplied from the reservoir by a direct, controllable connection 27.

It will be understood that the elements forming the pumping device are readily accessible for inspection and may consist of conventional structural elements.

What is claimed is:

1. A hot gas engine of the type comprising a first piston adapted to reciprocate in a first cylinder which is kept at a lower temperature level and a second piston adapted to reciprocate in a cylinder which is kept at a higher temperature level, the said two pistons forming walls of an enclosure containing a working gas charge, said enclosure also comprising a cooler, a regenerator and a heater, characterized in that said two pistons are disposed for movement in different directions by a common crank shaft and said cooler is disposed adjacent said first cylinder, a compressor pump having a cylinder is provided for pumping gas from said charge into a gas reservoir, the said first piston at its upper side operates a plunger working in said pump cylinder, a first check valve governed conduit is disposed from said pump cylinder to said gas reservoir and a second check valve governed conduit is disposed from a part of said enclosure located between said cooler and said first piston to said pump cylinder.

2. An engine as defined in claim 1, wherein said two cylinders are disposed at a 90° angle.

3. An engine as defined in claim 1 having power control means to control the gas pressure in said reservoir.

4. An engine as defined in claim 3, wherein said power control means comprises a by-pass control shunting said second check valve.

5. An engine as defined in claim 3, wherein said power control means comprises means to introduce gas into said enclosure.

* * * * *